United States Patent [19]

Rohner

[11] Patent Number: 4,739,611

[45] Date of Patent: Apr. 26, 1988

[54] PROCESS AND APPARATUS FOR REPLACEMENT OF AN EMPTY WITH A FULL ROVING BOBBIN IN A SPINNING MACHINE, PARTICULARLY A RING SPINNING MACHINE

[75] Inventor: Joachim Rohner, Mönchengladbach, Fed. Rep. of Germany

[73] Assignee: Zinser Textilmaschinen GmbH, Ebersbach/Fils, Fed. Rep. of Germany

[21] Appl. No.: 916,814

[22] Filed: Oct. 8, 1986

[30] Foreign Application Priority Data

Oct. 15, 1985 [DE] Fed. Rep. of Germany ..... 3536702

[51] Int. Cl.[4] ..... D01H 9/18

[52] U.S. Cl. ..... 57/276; 57/266; 57/268; 57/270; 57/281; 242/35.5 A

[58] Field of Search ..... 57/266–268, 57/270, 281, 275–278, 90; 242/35.5 R, 35.5 A

[56] References Cited

U.S. PATENT DOCUMENTS

| | | | |
|---|---|---|---|
| 3,828,682 | 8/1974 | Klein | 57/281 X |
| 3,935,821 | 2/1976 | Maier et al. | 57/281 X |
| 4,438,622 | 3/1984 | Pons | 57/266 X |
| 4,473,997 | 10/1984 | Kawasaki et al. | 57/276 |

FOREIGN PATENT DOCUMENTS

| | | |
|---|---|---|
| 3208677 | 9/1982 | Fed. Rep. of Germany . |
| 3210329 | 9/1983 | Fed. Rep. of Germany . |
| 3240822 | 5/1984 | Fed. Rep. of Germany . |
| 3312116 | 10/1984 | Fed. Rep. of Germany . |

*Primary Examiner*—John Petrakes

*Attorney, Agent, or Firm*—Karl F. Ross; Herbert Dubno; Ronald Lianides

[57] ABSTRACT

The process for replacing an empty roving bobbin with a full roving bobbin in a spinning machine, particularly in a ring spinning machine, in a dispensing position by an automatic roving bobbin changing device comprises taking the full roving bobbin from a storage location and putting the full roving bobbin in place of the empty roving bobbin. The full roving bobbin associated with the dispensing position is taken from one of a plurality of stand-by positions in the storage location. To provide a more automatic operation the process further comprises testing whether the full roving bobbin is present in one of the stand-by positions adjacent the dispensing position before beginning the exchange and when the absence of the full roving bobbin is indicated inducing a relative motion between the roving bobbin changing device and the stand-by positions until the roving bobbin changing device stands adjacent to one of the stand-by positions having a full roving bobbin. An apparatus for performing the process of our invention is also provided.

11 Claims, 5 Drawing Sheets

PROCESS AND APPARATUS FOR REPLACEMENT OF AN EMPTY WITH A FULL ROVING BOBBIN IN A SPINNING MACHINE, PARTICULARLY A RING SPINNING MACHINE

FIELD OF THE INVENTION

My present invention relates to a method of and apparatus for the replacement of an empty roving bobbin at its roving-feeding station in a spinning machine with a full roving bobbin from a magazine on the machine and, more particularly, to a process and apparatus for roving bobbin replacement in a ring spinning machine.

BACKGROUND OF THE INVENTION

A ring spinning machine can have an automatic roving bobbin changing device which travels along the bobbin cross bar or the machine frame and which draws a full roving bobbin from a storage magazine or storage location and puts it in a dispensing position in the spinning machine in place of an empty roving bobbin.

In the roving bobbin changing apparatus of German Open Patent Application No. 33 12 116 this storage magazine is provided in the automatic roving bobbin changing device so that the roving bobbin changing device carries its roving bobbin storage magazine with it. On account of its weight and its spatial requirements the capacity of this kind of storage location in its traveling roving bobbin changing device is limited. This requires frequent filling of the storage magazine during which the roving bobbin changing can not occur.

It is also known to suspend a row of stand-by roving bobbins from the bobbin cross bar of a ring spinning machine as taught in German Open Patent Application Nos. 32 10 329 and 32 40 822. These stand-by roving bobbins form a magazine fixed with respect to each dispensing position and can be used to replace empty bobbins either by hand or by an automatic roving bobbin changing device as needed (German Open Patent Application No. 32 08 677). Because of space considerations, each stand-by position is associated with a plurality, usually two sometimes three or four, dispensing positions.

When an automatic roving bobbin changing device moving along in the spinning machine acts on a dispensing position or feed position in which the associated stand-by position is already empty because of a change in this stand-by position due to another associated dispensing position, this automatic roving bobbin changing device can not perform its function at this site for lack of a full roving bobbin.

OBJECTS OF THE INVENTION

It is an object of the invention to provide an improved method of and apparatus for roving bobbin changing in a spinning machine, particularly a ring spinning machine, which obviates the drawbacks of the prior art.

It is also an object of my invention to provide a process and apparatus for replacement of an empty with a full roving bobbin in a spinning machine, particularly a ring spinning machine.

It is another object of my invention to provide a process and apparatus for replacing an empty roving bobbin with a full roving bobbin in a spinning machine which eliminates the problem associated with an empty roving bobbin of the reserve at the changing site.

SUMMARY OF THE INVENTION

These objects and others which will become more readily apparent hereinafter are attained in accordance with my invention in a process and apparatus for replacing an empty roving bobbin with a full roving bobbin in a dispensing position in a spinning machine, particularly a ring spinning machine, by an automatic roving bobbin changing device which takes a full roving bobbin from a storage location or reserve (magazine) and puts it in place of an empty roving bobbin.

According to my invention the full roving bobbin associated with the dispensing position is taken from one of a plurality of stand-by positions in a storage location and, before beginning the bobbin exchange, first testing is effected of whether the full roving bobbin is present in one of the stand-by positions associated with the dispensing position and when the absence of the full roving bobbin is indicated, a relative motion between the roving bobbin changing device and the stand-by positions is effected until the roving bobbin changing device stands opposite to one of the stand-by positions having a full roving bobbin. Thus my invention has the advantage that in every case the roving bobbin changing device can perform its function since according to the process of my invention it is guaranteed that the roving bobbin changing device always has a full roving bobbin at its disposal for every changing process.

There are two alternative embodiments of the process according to my invention. The relative motion can occur by travel of the roving bobbin changing device along the plurality of the stand-by positions until at one of the stand-by positions with a full roving bobbin and after taking the full roving bobbin it travels back to the dispensing position. Alternatively the relative motion occurs by moving stand-by positions which are constructed so as to be movable by the roving bobbin changing device which is stationary until one of the stand-by positions with a full roving bobbin arrives at the roving bobbin changing device.

My invention also provides an apparatus for performing the above process for replacing an empty roving bobbin with a full roving bobbin in a spinning machine. This apparatus includes an automatic roving bobbin changing device movable relative to the full roving bobbins which takes the full roving bobbin from a storage location and puts the full roving bobbin in place of the empty roving bobbin. A sensing device is provided for detection of the full roving bobbin in the stand-by position and for inducing a relative motion between the roving bobbin changing device and the stand-by position. The sensing device can activate the traveling drive of the roving bobbin changing device until the full roving bobbin is brought to the position for delivery. Alternatively the sensing device can activate a drive unit for moving the plurality of stand-by positions until the full roving bobbin is brought to a position for delivery.

According to my invention the sensing device can be mounted on the roving bobbin changing device. The sensing device advantageously has an optical detection unit and two light barriers which are interrupted and broken depending on a diameter difference between the full roving bobbin and the empty roving bobbin.

In one embodiment of my invention the drive unit can drive a patterned, e.g. toothed wheel or sprocket which can engage a traveling chain holding the roving bobbins in the stand-by position and the rotation of the toothed wheel is controllable by the optical detection unit.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
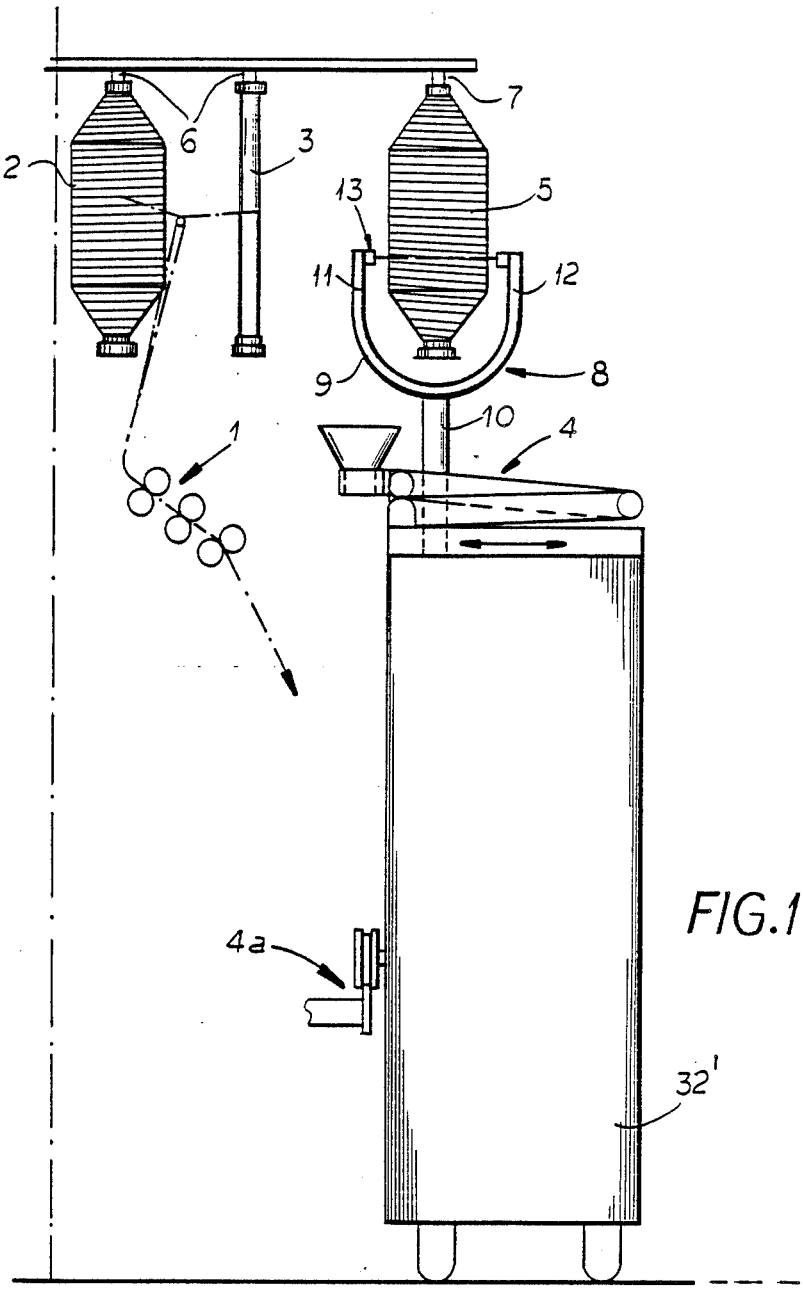
FIG. 1 is a side elevational view of one embodiment of the apparatus for roving bobbin replacement according to my invention.

A portion of a first embodiment of a ring spinning machine equipped with a set of drafting rolls 1 is shown in FIG. 1. Above the set of drafting rolls 1 roving bobbins 2 and 3 are shown in their dispensing positions on a roving bobbin cross bar 6. As is apparent the roving bobbin 3 is already about to run out of roving so that a replacement must occur shortly. A full roving bobbin 5 is found on the bobbin cross bar 6 in a stand-by position adjacent the nearly empty roving bobbin 3.

Near this full roving bobbin 5, held in reserve, a sensing device 8 for detecting a full roving bobbin is positioned before making the replacement. This sensing device 8 comprises a curved piece 9 with a free end 11 and a free end 12 on which the detection element 13 is mounted. In this case the sensing device 8 is optical. The sensing device 8 is mounted by a stand 10 on a schematically shown bobbin changing device 4.

Figure 2:
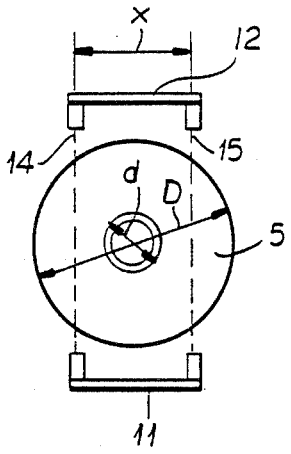
FIGS. 2 and 3 are top plan views showing a part of two different embodiments of the apparatus for roving bobbin replacement according to my invention each including a roving bobbin and light detector-barrier.

As can be seen in FIG. 2 the sensing device 8 has two light barriers 14 and 15 between both of its free ends 11 and 12. The distance x between both light barriers 14 and 15 is such that it is smaller than the diameter D of a full roving bobbin 5 but larger than the diameter d of an empty bobbin. Both light barriers 14 and 15 are interrupted, penetrated or broken when a full bobbin 5 is present directly adjacent the light barriers in the stand-by position 7.

A part of a traveling drive 4A which moves the roving bobbin changing device 4 relative to the full roving bobbin or bobbins 5 is shown in FIG. 1.

Figure 3:
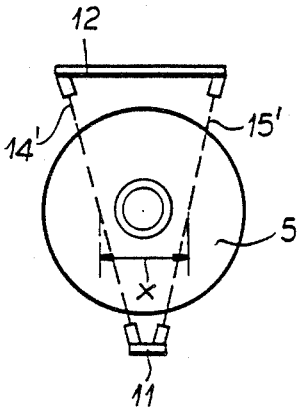

Another embodiment is shown in FIG. 3 in which the light barriers 14' and 15' are positioned at an angle to each other. Here also the distance x is less than the diameter D of the full roving bobbin 5 but greater than the diameter d of the empty roving bobbin.

In the embodiment according to FIG. 1—in case a full roving bobbin is present in the stand-by position 7 associated with the dispensing position of the bobbin 3—the bobbin changing device 4 with the device 8 travels along the row of stand-by roving bobbins until it detects a full roving bobbin 5 mounted in a stand-by position. This detection occurs by penetration of the light barriers 14 and 15 in the sensing device 8. After the removal of the full roving bobbin 5 from the stand-by position 7 the bobbin changing device 4 then can travel back to the dispensing position under power of the traveling drive 4A and there the bobbin replacement is performed, that is, the empty bobbin 3 is replaced by the full bobbin 5.

Figure 5:
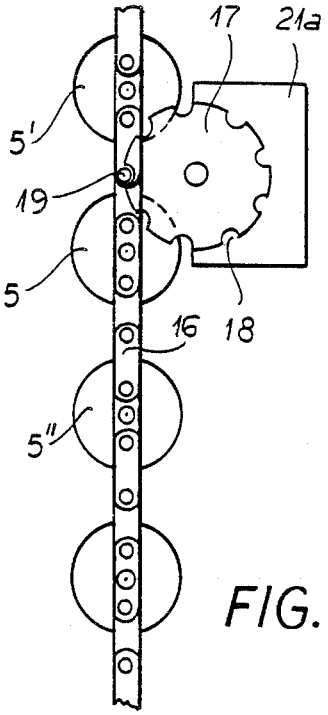
FIG. 5 is a partially cutaway top view of the apparatus according to FIG. 4.
Figure 4:
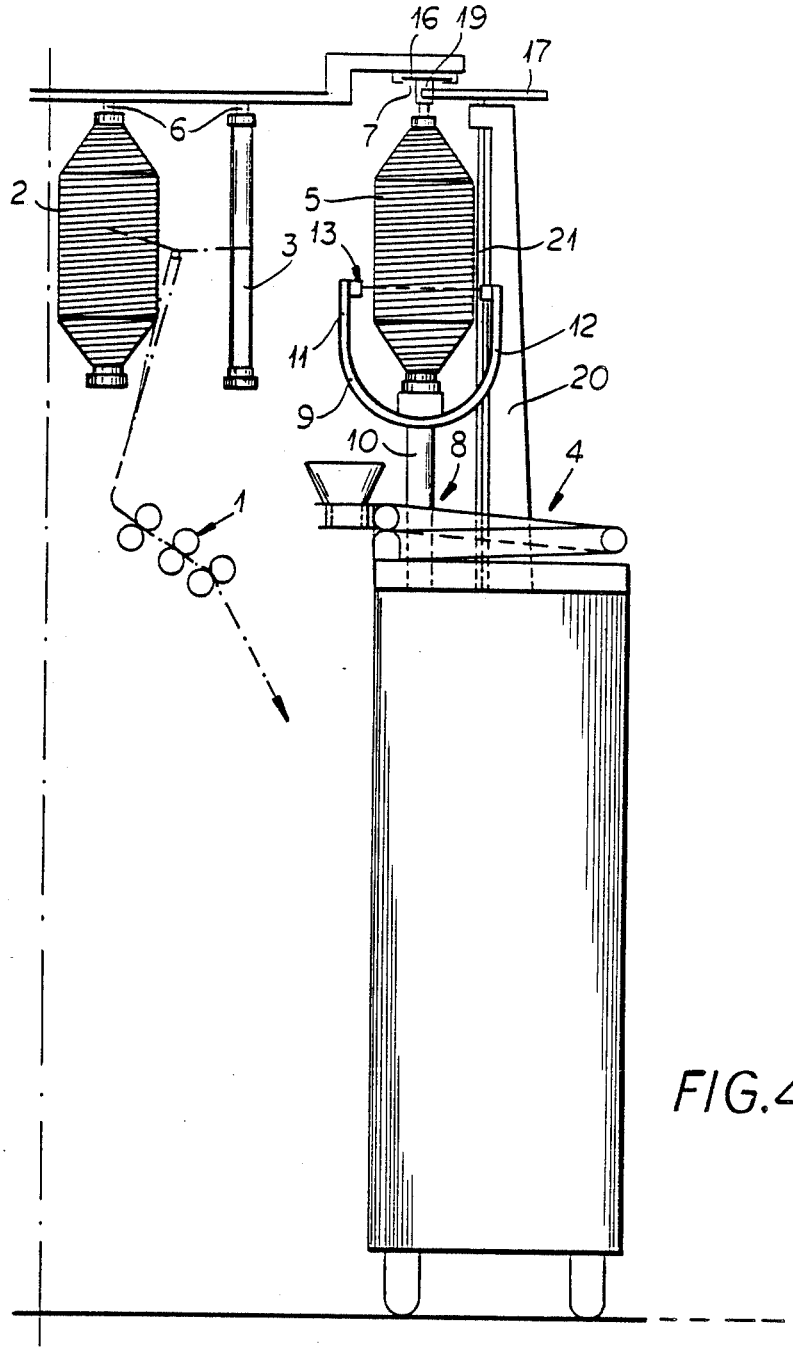
FIG. 4 is a side elevational view of another embodiment of the apparatus for roving bobbin replacement according to my invention.

As shown in FIGS. 4 and 5 the full roving bobbins 5, 5', and 5'' are mounted on a pulling device, for example a traveling chain 16. This traveling chain 16 is movable along the bobbin cross bar 6.

In this embodiment the bobbin changing device 4 is provided additionally with a supporting member 20 which supports a drive shaft 21 of a drive unit **21*a*. A toothed wheel 17 with recesses 18 in its outer periphery is attached to the upper part of the drive shaft 21. These recesses 18 can cooperate with pins 19 attached to the traveling chain 16**.

Again a situation is shown in FIG. 4 in which the roving bobbin 3 found in the dispensing position is about to run out of roving. In this case—a case in which a full roving bobbin is not already in the stand-by position 7 associated with the dispensing position of the bobbin 3—the pulling member containing the stand-by bobbins 5, 5', and 5'', that is the traveling chain 16, is pushed by the bobbin changing device 4 until the sensing device 13 detects a full stand-by bobbin 5 at the dispensing position in the automatic bobbin changing device 4 and initiates the changing process.

In every case it is guaranteed by the sensing device 8 according to my invention that the bobbin changing device 4 first finds a full roving bobbin 5 in the stand-by position and that the bobbin changing process can be performed in a desirable reliable way.

Figure 6:
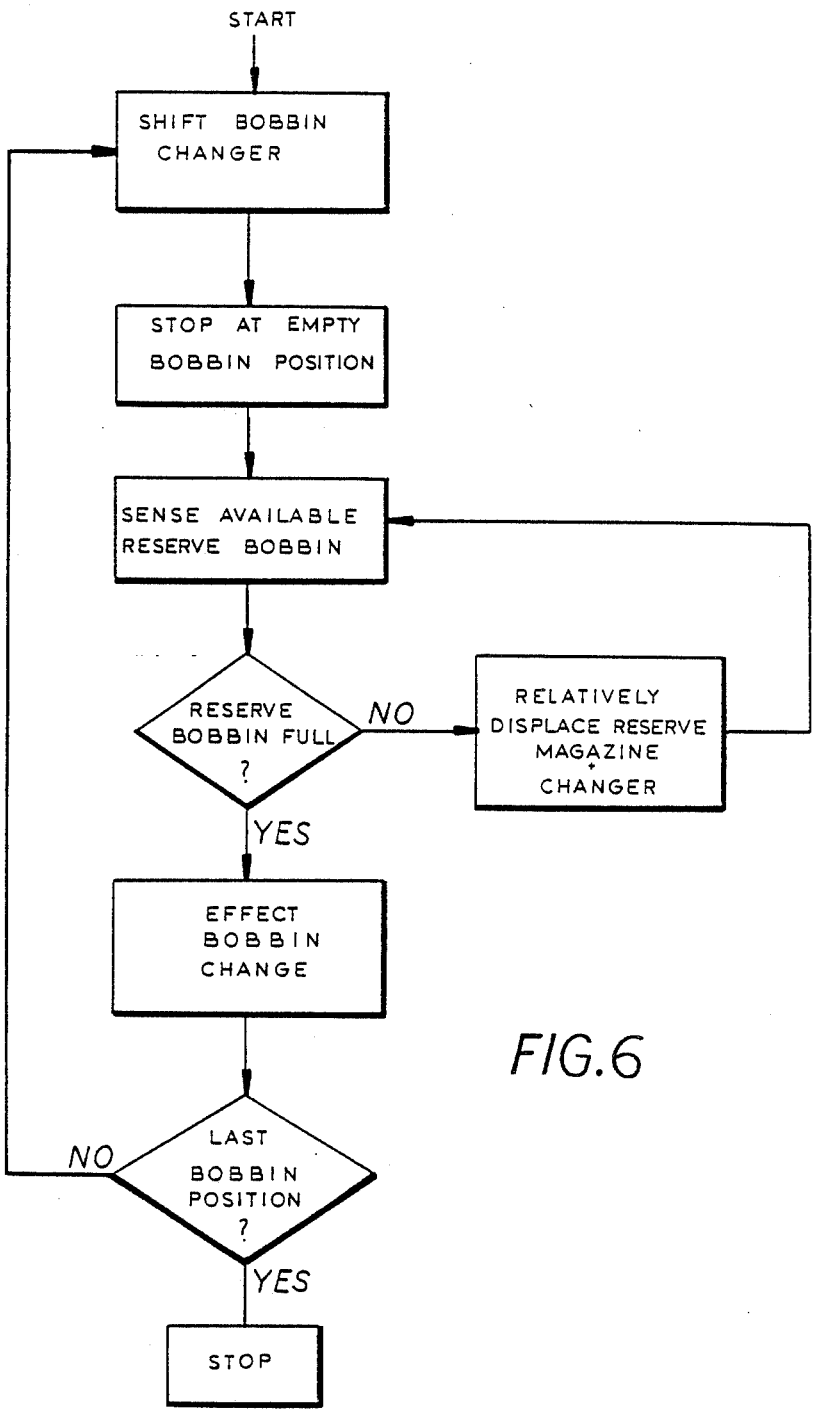
FIG. 6 is a diagram of the control operation of the invention.
Figure 7:
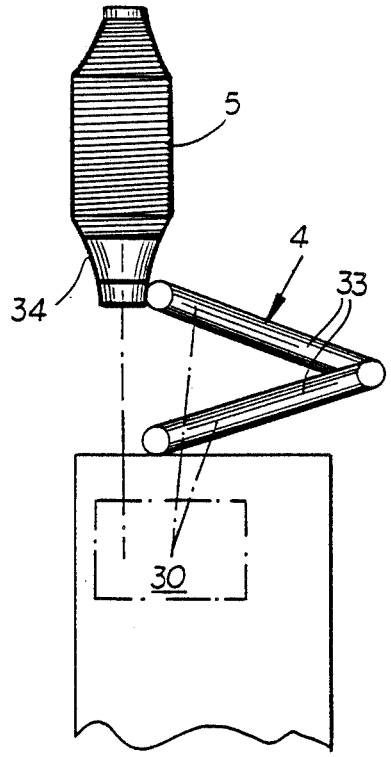
FIG. 7 is a detail corresponding to FIG. 1 showing a bobbing change in progress.
Figure 8:
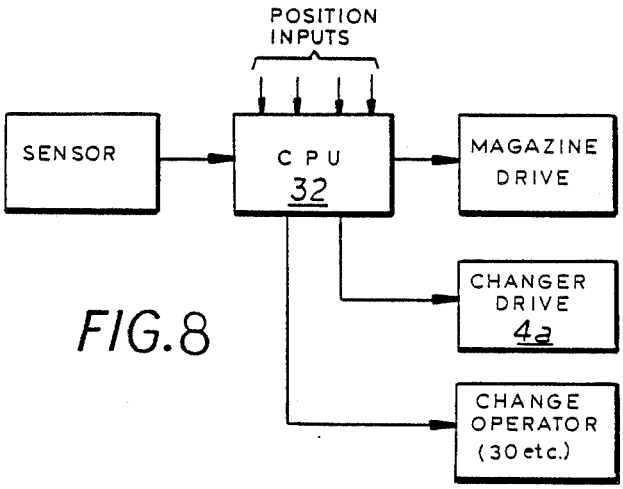
FIG. 8 is a block circuit diagram of the controller.

FIG. 6 shows the program followed by the apparatus of the invention. Once the program is initiated the entire changer 4 is moved by the drive **4*a* under the control of the microcomputer 32 until an empty bobbin is detected at its sensing position, e.g. the bobbin 3. The sensing means for this purpose can be any art-recognized device for signalling an empty bobbin. Once the carriage 32 has stopped at this position, the sensor 8 detects whether the available reserve bobbin is empty (missing) or full, the reserve or store of bobbins and the changer are displaced relatively with sensing being repeated until a full bobbin is detected. Then bobbin exchange is effected between position 3 and the now available full reserve bobbin. To this end the arms 33 and the bobbin gripper 34 can be actuated (FIG. 7) to grip this bobbin and effect transfer using the drive 30 (FIGS. 7 and 8). When bobbin change is complete, the bobbin changer is shifted along the frame (drive 4A) until the last bobbin position is reached. After a time, a new bobbin change movement, e.g. of the carriage 32'** in the opposite direction can be effected.

We claim:

1. In a process for replacing an empty roving bobbin in a dispensing position with a full roving bobbin in a spinning machine, particularly in a ring spinning machine, by an automatic roving bobbin changing device movable relative to said full roving bobbin comprising taking said full roving bobbin from a storage location and putting said full roving bobbin in place of said empty roving bobbin, the improvement wherein said full roving bobbin associated with said dispensing position is taken from one of a plurality of stand-by positions in said storage location and before beginning the exchange of said bobbins first testing whether said full roving bobbin is present in said one of said stand-by positions associated with said dispensing position and when the absence of said full roving bobbin is indicated inducing a relative motion between said roving bobbin changing device and said stand-by positions until said roving bobbin changing device stands adjacent to another one of said stand-by positions having one of said full roving bobbins.

2. The improvement according to claim 1 wherein said relative motion occurs by said roving bobbin changing device traveling along said plurality of said stand-by positions until at said one of said stand-by positions having said full roving bobbin and after taking said full roving bobbin traveling back to said dispensing position.

3. The improvement according to claim 1 wherein said relative motion occurs by moving movable ones of said stand-by positions by said roving bobbin changing device which is stationary until one of said full roving bobbins arrives at said roving bobbin changing device.

4. An apparatus for replacing an empty roving bobbin with a full roving bobbin in a dispensing position in a spinning machine, particularly in a ring spinning machine, by an automatic roving bobbin changing device comprising:

a means for moving said full roving bobbin from a stand-by position of a storage location and positioning said full roving bobbin in place of said empty roving bobbin; and a sensing device comprising means for initially detecting whether said full roving bobbin is present in said stand-by position and for inducing a relative motion between said means for moving said roving bobbin and said stand-by position when the absence of said full roving bobbin is indicated.

5. The improvement according to claim 4 further comprising a traveling drive means for driving said means for moving said roving bobbin, and wherein said sensing means activates said traveling drive means until said full roving bobbin is brought to said dispensing position.

6. The improvement according to claim 4 further comprising a drive unit means for moving a plurality of stand-by positions, and wherein said sensing device means activates said drive unit means until said full roving bobbin is brought to said dispensing position.

7. The improvement according to claim 6 wherein said sensing device means is mounted on said means for moving said full roving bobbin.

8. The improvement according to claim 7 wherein said sensing device means has an optical detection unit.

9. The improvement according to claim 8 wherein said optical detection unit has two light barriers which are penetrated and broken depending on a diameter difference between said full roving bobbin and said empty roving bobbin.

10. The improvement according to claim 9 wherein said means for moving said full roving bobbin is a traveling chain and said drive unit has a toothed wheel which can engage with said traveling chain holding said roving bobbins in said stand-by positions and the rotation of said toothed wheel is controllable by said optical detection unit.

11. A process for replacing an empty roving bobbin in a dispensing position with a full roving bobbin in a spinning machine, particularly in a ring spinning machine, by an automatic roving bobbin changing device movable relative to said full roving bobbin comprising:

a. before beginning the exchange of said bobbins first testing whether said full roving bobbin is present in the one of a plurality of stand-by positions adjacent said dispensing position for said exchange;

b. when the absence of said full roving bobbin is indicated adjacent said dispensing position inducing a relative motion between said roving bobbin changing device and said stand-by positions until said roving bobbin changing device stands adjacent to another one of said stand-by positions having one of said full roving bobbins;

c. taking said full roving bobbin from said other one of said stand-by positions with said roving bobbin changing device, d. if necessary moving said roving bobbin changing device relative to said empty roving bobbin until said full roving bobbin is adjacent said dispensing position for said exchange; and e. putting said full roving bobbin at said dispensing position in place of said empty roving bobbin.

* * * * *